US008255285B1

(12) United States Patent
Peretz et al.

(10) Patent No.: US 8,255,285 B1
(45) Date of Patent: Aug. 28, 2012

(54) PROPOSING A BID VALUE TO A USER

(75) Inventors: Ervin Peretz, Redmond, WA (US); Sasank Mudunuri, San Francisco, CA (US)

(73) Assignee: Google Inc., Mountain View, CA (US)

( * ) Notice: Subject to any disclaimer, the term of this patent is extended or adjusted under 35 U.S.C. 154(b) by 589 days.

(21) Appl. No.: 12/394,392

(22) Filed: Feb. 27, 2009

(51) Int. Cl.
*G06Q 30/00* (2006.01)

(52) U.S. Cl. ..... 705/26.3; 705/14.71

(58) Field of Classification Search ..... 705/14.1–73
See application file for complete search history.

(56) References Cited

U.S. PATENT DOCUMENTS

| | | | | |
|---|---|---|---|---|
| 7,672,894 | B2 * | 3/2010 | Rebane et al. | 705/37 |
| 7,689,463 | B1 * | 3/2010 | Mesaros | 705/26.5 |
| 7,693,748 | B1 * | 4/2010 | Mesaros | 705/26.42 |
| 2001/0039519 | A1 * | 11/2001 | Richards | 705/27 |
| 2002/0147675 | A1 * | 10/2002 | Das et al. | 705/37 |
| 2003/0088525 | A1 * | 5/2003 | Velez et al. | 705/400 |
| 2010/0131387 | A1 * | 5/2010 | Duquette | 705/26 |

OTHER PUBLICATIONS

Wurman, "Computing Price Trajectories in Combinatorial Auctions with Proxy Bidding," Jun. 25, 2004, Computer Science Department, North Carolina State University, Raleigh, NC 27695-7535; pp. 1-18.*

* cited by examiner

*Primary Examiner* — Adam Levine
(74) *Attorney, Agent, or Firm* — Fish & Richardson P.C.

(57) ABSTRACT

A computer-implemented method for proposing a value to a user includes mapping a plurality of factual cost values for an item type according to amount, each of the factual cost values reflecting an amount that won a bidding process for an item of the item type. The method includes identifying an inflection point in the mapping that represents a first factual cost value. The method includes outputting a proposed value for the bidding process to a user, the proposed value generated using the first factual cost value. The method can be implemented using a computer program product.

16 Claims, 4 Drawing Sheets

PROPOSING A BID VALUE TO A USER

TECHNICAL FIELD

This document relates to information processing.

BACKGROUND

Contents can be distributed by any of multiple types of entities, such as by an advertiser who circulates advertising content. Advertisers can run advertisement campaigns in any of multiple different platforms, including the Internet, television, radio, printed media and billboards. Advertisements used in advertising campaigns can cover a range of products and services and can be directed toward specific audiences or more generally toward the greater population. For example, publishers operating websites can provide space to advertisers for presenting advertisements. Advertisements presented on a website are sometimes selected based on the content of the website.

SUMMARY

In a first aspect, a computer-implemented method for proposing a value to a user includes mapping a plurality of factual cost values for an item type according to amount, each of the factual cost values reflecting an amount that won a bidding process for an item of the item type. The method includes identifying an inflection point in the mapping that represents a first factual cost value. The method includes outputting a proposed value for the bidding process to a user, the proposed value generated using the first factual cost value. The method can be implemented using a computer program product.

Implementations can include any, all or none of the following features. The method can further include generating a mathematical representation of the mapping; wherein the inflection point is identified using the mathematical representation. Generating the mathematical representation can include arranging the plurality of factual cost values according to amount. Identifying the inflection point can include identifying where in the mathematical representation a polygon defined relative to the mathematical representation has a maximum size, the polygon having a first corner on the first factual cost value and being bounded by a maximum factual cost value and an axis of the mathematical representation. The polygon can be a rectangle having a second corner on an extreme value on a vertical axis of the mathematical representation. The method can further include applying a normalizing multiplicative factor to obtain normalized edges of the rectangle; and calculating the maximum size of the rectangle using the normalized edges. The method can further include mapping the mapping at a highest factual cost value, such that higher factual cost values are not included in the mapping. The proposed value can be generated using a projected auction model regarding the bidding process for a site placement on a particular day. The plurality of factual cost values can be arranged in non-decreasing order along a horizontal axis of the visual representation. The mathematical representation can include bids that have won or are projected to win the bidding process for impression on site placement. The item type can include electronic publishing of content, and the proposed value can be determined to generate an estimated number of impressions for the content. The content can be an advertisement from an advertiser seeking to participate in the bidding process to publish the advertisement. The proposed value can include a bidding amount that based on historical data is required to win the bidding process. The item type can include at least one of tangible objects and services offered at an auction. The item type can include a transportation service. The item type can include energy provided from an energy distributor for consumption.

In a second aspect, a computer system includes a tangible medium including a plurality of factual cost values for an item type mapped according to amount. Each of the factual cost values reflects an amount that won a bidding process for an item of the item type. The computer system includes a proposal component generating a proposed value, including identifying an inflection point in the mapping that represents a first factual cost value, the proposed value generated using the first factual cost value. The computer system includes an output device outputting a proposed value for the bidding process to a user.

Implementations can include any, all or none of the following features. The proposal component can generate a mathematical representation of the mapping, and identify the inflection point using the mathematical representation. The proposal component can identify where in the mathematical representation a polygon defined relative to the mathematical representation has a maximum size, the polygon having a first corner on the first factual cost value and being bounded by a maximum factual cost value and an axis of the mathematical representation.

Implementations can provide any, all or none of the following advantages. Factual cost values relating to content distributions can be mapped, an inflection point can be determined using the mappings, and based on such information a proposed bidding value can be generated for a user. A improved bidding component can be provided that proposes bidding values to a user for a content distribution process.

The details of one or more implementations are set forth in the accompanying drawings and the description below. Other features and advantages will be apparent from the description and drawings, and from the claims.

DESCRIPTION OF DRAWINGS

Like reference symbols in the various drawings indicate like elements.

DETAILED DESCRIPTION

Figure 1:
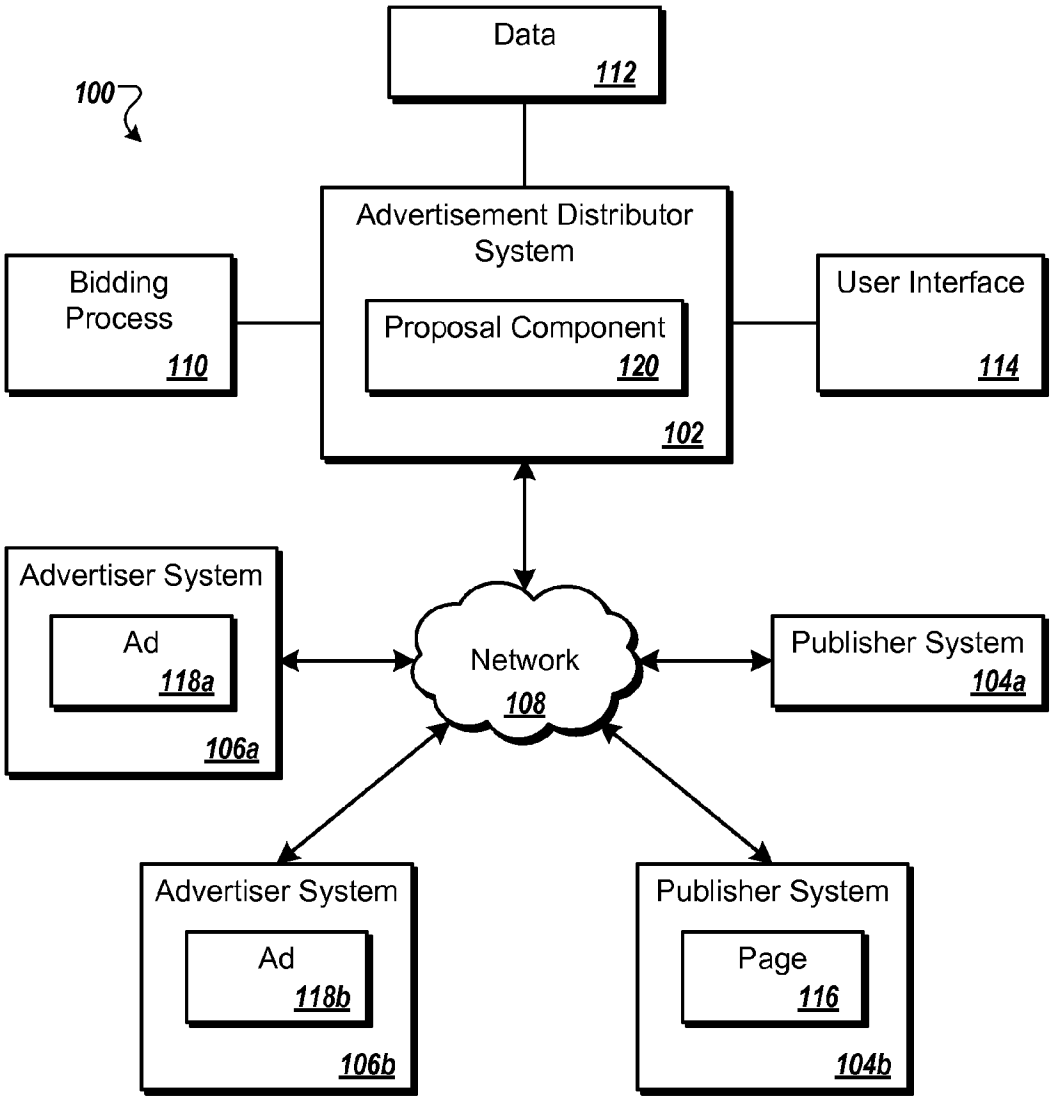
FIG. 1 is an example system that can be used for generating content distribution bid proposals and displaying content.

FIG. 1 is an example system 100 that can be used for generating content distribution bid proposals and displaying content. The system 100 can be used for distribution of any type of contents, including media, images, text, data, graphics, or any other kind of information. Other types of content can include information representing transportation services, forms of energy (e.g., natural gas, coal, electricity, solar energy, etc.), vacation services, auction based items, and utility services (e.g., water, electricity, phone service, etc.), to name a few examples. In some implementations, at least part of the content being distributed can include an advertisement, and an advertiser can submit a bid in a bidding process to have the advertisement or other content distributed in an advertisement campaign. For example, the advertising campaign can take into account advertiser goals, such as the number of daily impressions, maximizing the number of unique viewers of the advertisement, or the type of audience viewing the advertisements. Some other goals can include minimizing cost of the advertising campaign, distributing the budget evenly across the desired sites the advertisement will be displayed on, or some combination thereof.

Historical advertising campaign data can, for example, be used to generate a model of future advertising campaigns. The historical data can be used in the generation of the advertisement campaign bid proposal. The campaign bid proposal can, for example, be based on an inflection point in an ordered histogram of factual cost values for advertisement campaigns. In some implementations, the system 100 can use historical data and advertiser goals in order to generate and propose a suggested bid for distributing content, such as an advertisement campaign bid to an advertiser.

In some implementations, content, such as an advertisement, can include any form of communication in which one or more products, services, ideas, messages, people, organizations or other items are identified and promoted, or otherwise communicated. Advertisements are not limited to commercial promotions or other communications. An advertisement may be a public service announcement or any other type of notice, such as a public notice published in printed or electronic press or a broadcast. An advertisement may be referred to or include sponsored content.

Contents, such as advertisements, can be communicated via any of various mediums and in various forms. In some examples, advertisements may be communicated through an interactive medium, such as the Internet, and may include graphical advertisements (e.g., banner advertisements), textual advertisements, image advertisements, audio advertisements, video advertisements, advertisements combining one of more of any of such components, or any form of electronically delivered advertisement, to name a few examples. Contents can include embedded information, such as embedded media, links, meta-information, and/or machine executable instructions. Contents can be communicated through RSS (Really Simple Syndication) feeds, radio channels, television channels, print media, and other media, for example.

Here, the system 100 includes an advertisement distributor system 102, publisher systems 104*a-b*, advertiser systems 106*a-b*, and any kind of network 108. The advertisement distributor system 102, publisher systems 104*a-b*, and advertiser systems 106*a-b* can communicate via any kind of network 108. The network 108 can, for example, include a wide area network (WAN), local area network (LAN), an intranet, the Internet, a telephone connection, or any other form of connection. In some implementations, publisher systems 104*a-b* are the same publisher system, or can include two or more publisher systems. The publisher systems 104*a-b* can, for example, be distributed over one or more physical machines. In some implementations, the advertiser systems 106*a-b* can be the same system, or can include two or more advertiser systems. The advertiser systems 106*a-b* can, for example, reside on the same physical machine or on two or more physical machines. Examples of physical machines include computer servers, personal computers (e.g., desktop computers), mobile computing devices, media devices, or other electronic devices and the like.

The advertisement distributor system 102 can be used for distribution of any kind of content, such as advertisements. Here, the advertisement distributor system 102 is associated with a bidding process 110, data 112, and a user interface 114; and contains a proposal component 120. For example, the bidding process 110 can facilitate bid submission by advertisers or other content providers; collect and evaluate submitted bids; and award content distribution rights to one or more bidders according to one or more rules. Rules can include awarding rights to the highest bidder, or in recognition of services performed (e.g., because of the community commitment of the content provider), to name a few examples.

In some implementations, the proposal component 120 and/or the bidding process 110 can generate one or more advertisement campaign proposals for presentation to a prospective bidder. For example, a proposal can help a prospective bidder to avoid over- or underbidding in a particular bidding process. In some implementations, the proposals are submitted to the advertisement distributor system 102, publisher system 104*a*, or publisher system 104*b*. The advertisement distributor system 102 can, for example, be associated with an advertiser system or a publisher system, such as the advertiser system 106*a* or the publisher system 104*b*. For example, if the advertisement distributor system 102 receives the submitted proposal, the bid proposal can be sent to a publisher system associated with the advertisement distributor system 102. In other implementations, the advertisement distributor system 102 can accept bids and/or grant distribution rights on behalf of a publisher system, such as publisher system 104*a*. The advertisement distributor system 102 can, for example, track information related to submitted bid proposals.

An advertisement campaign proposal can relate to any kind of contents such as one or more advertisements. When an advertisement campaign includes multiple advertisements, the advertisements can be for related goods or services, or for unrelated goods or services. In some implementations, the advertisements are of a similar creative type or of a variety of creative types. Creative types can, for example, include text advertisements, video advertisements, image advertisements, audio advertisements, or gadgets, to name a few examples.

The proposal component 120 can, for example, use historical data, such as data 112, for the generation of a model of the advertisement bidding process. The advertisement bidding process model can be used to create an advertisement campaign proposal. The data 112 can include historical information on previous advertisement campaigns including the website(s) used, the goals of previous campaigns, the cost per thousand impressions (CPM), the daily pageviews, the number of unique viewers of the campaigns, or factual cost values, among others. Historical data can include region information, such as information on the cost of advertising campaigns or the number of daily impression views in certain countries, states, provinces, or cities, to name a few examples. Historical data can, for example, include information related to any other type of content campaign. In some implementations, the historical data can be values for an item and can be mapped or arranged into an ordered histogram according to amount. For example, the proposal component 120 can identify an inflection point in the mapping and generate an advertisement campaign bid proposal using information relating to the inflection point. The proposal component 120 can, for example, present the bid proposal to a prospective bidder in a graphical user interface (GUI).

In some implementations, the proposal component 120 can generate a model of the advertisement bidding process in real time. This can, for example, provide more accurate bidding process models. In other implementations, the generation of a model of the content bidding process can be run on a schedule, such as weekly, monthly, or at any other time interval. For example, a schedule can be selected based on the performance or accuracy of campaign proposals created from the bidding process model, time and/or cost considerations for the generation of the bidding process model (e.g., computation time), or any other criteria.

For example, the proposal component 120 can take into account the date of the data 112 and the date for the desired advertising campaign in the generation of the proposal. The proposal component 120 can determine patterns based on time of year, season, holidays, or other date related trends, that may influence an advertising campaign. In some implementations, more recent historical data will have more of an influence on the proposal component 120 compared to historical data that is a few years old. In other implementations, historical data that is a year or two old will have more weight in the generation of a bid proposal than historical data for an advertising campaign that occurred a week before the generation of the proposal. In certain implementations, the proposal component 120 can generate one or more advertisement campaign proposals. For example, the proposal component 120 can generate a bid proposal for the advertisement campaign if the campaign started the day after the proposal is presented to the user, and generate another proposal for a week later, or any other combination of number of proposals and campaign start dates. The one or more advertisement campaign proposals can be presented to the user in an overview with navigation to more specific data for each of the different proposals (e.g., on a computer display).

The proposal component 120 can, for example, analyze the data 112 using one or more of logistic regression, Poisson regression, linear regression, or nonparametric regression, to name a few examples. The proposal component 120 can use artificial intelligence, such as machine learning, to update the algorithm that generates the model for the advertising campaign bid proposal. Examples of machine learning algorithm types can include supervised learning, unsupervised learning (e.g., neural networks), reinforcement learning, or any other algorithm type. In some implementations, the proposal component 120 can receive submitted bid proposals and track information relating to the bid proposal. Tracked information can include acceptance rate of the bid proposal, success of the content campaign (e.g., how accurate the information provided in the bid proposal was in light of the campaign results), CPM value(s) included in the bid proposal, or forecasted number of impression, to name a few examples. Tracked information, or any other information relating to the submitted bid proposals, can, for example, be used to update the algorithm used to analyze the data 112, such as historical data, or the algorithm used to make projections of future bidding conditions.

In some implementations, the data 112 is collected by the advertisement distributor system 102. In other implementations, advertiser systems 106*a-b* and/or publisher systems 104*a-b* provide historical data to the advertisement distributor system 102 for the data 112. For example, the advertisement distributor system 102 can track information on all past bidding activities for content campaigns, both successful and unsuccessful. The tracked historical information can then be included in the data 112 for use in generating future content distribution bid proposals. In some implementations, bid history information is only collected with the permission of the bid submitting parties.

The proposed bid can represent an effort to inform the content provider about the level of bid that is likely to be necessary to win the bidding process. In some implementations, past bidding activities are taken into account, such as from the data 112, to estimate the bid amount for a successful submission. For example, the proposal component 120 can attempt to optimize the advertiser's bid by determining a lowest bid level that is statistically consistent with a predetermined likelihood of prevailing in the bidding process.

The user interface 114 can, for example, present the generated advertising campaign bid proposal to a user, such as an operator of the advertiser system 106*b*. The user interface 114 can be displayed in a web browser, in an applet, in a plug-in, or by any other kind of software application, to name a few examples. The bidding process 110, the data 112, and the user interface 114 can be managed by the same device such as a server, different devices, or a combination thereof. Examples of the devices running the bidding process 110, the data 112, and the user interface 114 can alternatively include, but are not limited to, personal computers, laptop computers, mobile computing devices, cell phones, smart phones, tablet computers, game consoles, media centers, media players, personal digital assistants (PDAs), television systems, audio systems, radio systems, removable storage devices, navigation systems, set top boxes, or some other form of electronic device instead of a server.

Publisher systems 104*a-b* can include any kind of media content, such as one or more websites, to present content to users. The content can include one or more pages, such as a page 116 owned by publisher system 104*b*. The publisher system 104*a* can, for example, have a website relating to news, and publisher system 104*b* can have a website relating to sporting goods, such as volleyball equipment. Publishers' media content can be configured for displaying one or more other content portions, such as advertisements or advertisement-related information, to users viewing the content. The advertisements can be for goods and/or services related to the content of the websites or for goods and/or services that users who typically view the website may be interested in, to name a few examples.

In some implementations, publisher systems 104*a-b* can offer content space directly to content providers, such as advertiser systems 106*a-b*. In other implementations, publisher systems 104*a-b* can offer content space to advertiser systems 106*a-b* through the advertisement distributor system 102. In some implementations, the advertisement distributor system 102 can host one or more servers for a publisher's media content, such as web servers for one or more websites owned by the publisher systems 104*a-b*. Content space can, for example, be published electronically, in hardcopy, or some other format.

The advertiser systems 106*a-b* can have stored therein one or more advertisements 118*a-b* respectively. Advertisements 118*a-b* can, for example, include one or more advertisement portions. If advertisement 118*b* includes more than one advertisement portion, the advertisement portions can relate to the same advertising campaign or to multiple advertising campaigns.

For example, the advertiser system 106*a* can use the user interface 114 to obtain a proposed bid for content distribution, such as an advertising campaign bid proposal for the advertisement 118*a*. In some implementations, the proposal can be obtained as follows. The advertiser system 106*a* can provide information on the desired goal of the advertising campaign. Advertising campaign goals can include a daily budget or a daily number of impressions, to name a few examples. Some additional goals can include maximization of individual impressions, presentation to a targeted audience type (e.g., based on demographic data), or distribution of the budget evenly between publisher websites. The proposal component 120 and/or the bidding process 110 can then perform relevant information processing and generate a proposed bid for the advertiser system 106*a*. The proposed bid can then be presented to the advertiser system 106*a* in the user interface 114.

Figure 2:
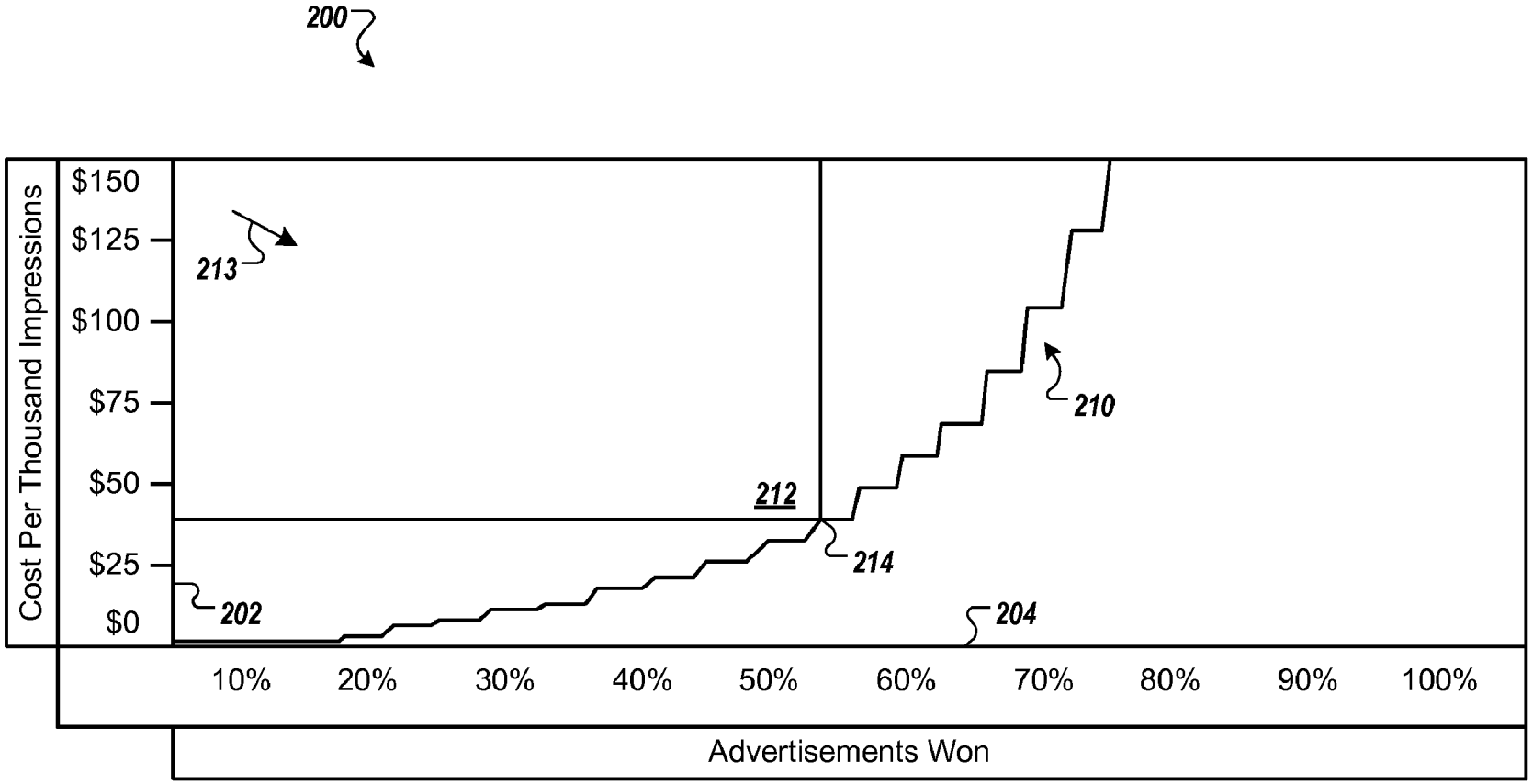
FIG. 2 is a graph of an example histogram of factual cost values.

FIG. 2 is a graph 200 of an example histogram that is a mathematical representation of a mapping of recorded winning bids for a day. Here, the graph 200 contains a vertical axis 202, a horizontal axis 204, a line 210 of values, and a polygon 212. The vertical axis 202 contains a scale for measuring the values for potential bids on a thousand impressions. The horizontal axis 204 indicates the total percent of advertisements won given a CPM bid for a day. The bids can be organized according to amount, such as from the lowest to the highest. The vertical axis 202 can be used to determine an estimated number of impressions. For example, an advertiser, such as an operator of advertiser system 106*a*, bid $40 per thousand impressions to place ads on a website, such as the page 116, for a day, and won 55% of the daily impressions on the website (e.g., the page 116). If the website has one million daily impressions, then the advertiser in this example bid won 550,000 impressions. In some implementations, the histogram can contain information on winning bids for other item types, including auction based items, vacation services, forms of energy, utility services, or transportation services, to name a few examples.

The information underlying the graph 200 can, for example, be compiled by the proposal component 120 using historical data, such as the data 112. In some implementations, the historical data can be bounded by a maximum bid value, a minimum bid value, or a maximum percent of advertisements won, to name a few examples. In other implementations the historical data can be unbounded. In the case where the historical data is unbounded, the proposal component 120 can, for example, create one or more bounds for the graph 200 during the process of generating the graph 200. The proposal component 120 can then discard any values outside of the bounds. For example, when the historical data includes extremely high and extremely low bidding values that are outside of the standard deviation, the proposal component 120 can disregard one or both of the sets of bidding values. Bounds can, for example, be used to create upper and lower limits for the vertical axis 202 and/or the horizontal axis 204. The graph 200 is described in this example for clarity; in some implementations, the methods and techniques discussed here can be performed using a mathematical representation without actually generating and/or displaying a graph.

Here, the graph 200 has a maximum bid value of $150 and a minimum bid value of $0. The vertical axis 202 can, for example, have upper and lower limits or bounds representing the maximum and minimum bid values respectively. In some implementations, the proposal component 120 can normalize the values of the graph 200, the line 210, and/or the polygon 212. The proposal component 120 can, for example, use a normalizing multiplicative factor. The polygon 212 can, for example, be normalized in order to obtain normalized edges. The horizontal segments of the line 210 can, for example, be normalized by moving the segments with more winning bids to the right and segments with less winning bids down.

Here, the line 210 charts the historical winning bid data in the graph 200. In some implementations, the historical winning data can be based on the data 112. The line 210 can include values of bids that have won or are projected to win a bidding process for impressions on a website. The line 210 can, for example, be increasing or non-decreasing along the horizontal axis 204.

In this implementation, the polygon 212 is a rectangle, and the top and left sides of the polygon 212 are bounded by the upper limit of the vertical axis 202 and the lower limit of the horizontal axis 204 respectively. In other implementations, the polygon 212 is a digon, a triangle, a pentagon, an octagon, a tridecagon, or another form of quadrilateral, to name a few examples. The polygon 212 can, for example, be selected such that it has a maximum size in the graph 200 and is located above the line 210. In some implementations, the polygon 212 can be selected such that it lies below the line 210, has a maximum size (e.g., not exceeding a specified size limit), or has a minimum size (e.g., meets certain size requirements), to name a few examples. Here, the intersection of the top and left vertices of the polygon 212 is at the point on the vertical axis corresponding to the maximum bid value of $150.

The polygon 212 can be generated starting at an upper left corner of the graph 200, where the axis 202 meets the upper bound of a $150 bid. The polygon 212 can then be enlarged to gradually expand into the graph 200 until the opposite corner of the polygon abuts the line 210, as indicated by arrow 213. In some implementations, the polygon 212 can intersect the line 210 at a point 214 as illustrated in this example. The point 214 can be a "knee" or other inflection point in the line 210, such as where the initial flat slope turns upward a bit more steeply; or a point in the line 210 where the slope exceeds a specified value for the first time since the origin of the graph 200 (e.g., a slope of one); to name just a few examples. The proposal component 120 can, for example, use the point 214 to determine an advertisement campaign bid proposal.

In some implementations, any of multiple other approaches for identifying an inflection point can be used. For example, a numerical analysis of curve slope can be applied to the line 212 to determine the location of the inflection point. As another example, the line 212 can be approximated using a polynomial function or a trigonometric function, and the inflection point can be analytically determined by analyzing the function. Other approaches can be used.

Figure 3:
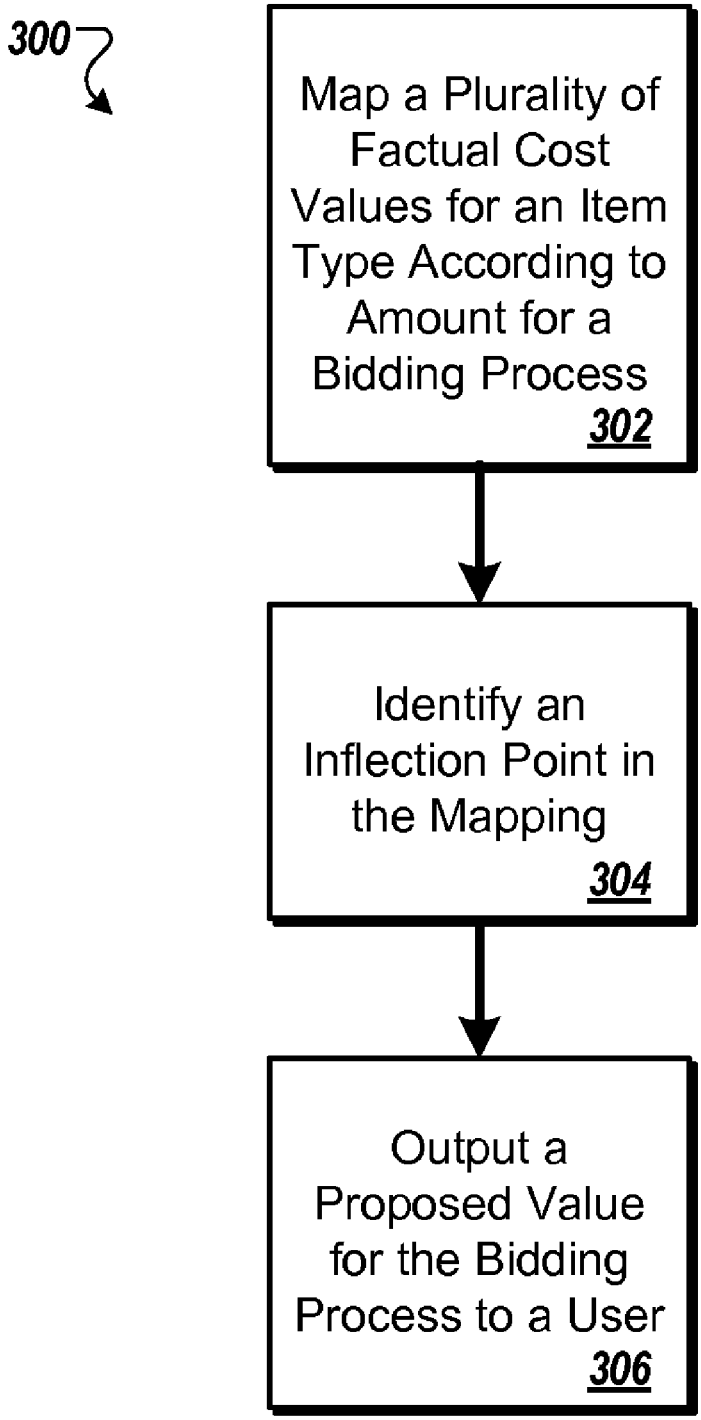
FIG. 3 is a flow chart of an example method that can be performed to determine a proposed bid value.

FIG. 3 is a flow chart of an example method 300 that can be performed to determine a proposed bid value. The method 300 can, for example, be used to identify a cost value and present a proposal generated from the cost value. The system 100 and parts thereof will be referred to in the following as examples. The method 300 can be performed by one or more other systems in conjunction with or instead of the system 100. One or more steps of the method can be performed in a different order; as another example, more or fewer steps can be performed. The method 300 can be performed by a processor executing instructions stored in a computer program product.

Step 302 maps a plurality of factual cost values for an item type according to amount. Each of the factual cost values reflects an amount that won and/or is projected to win a bidding process for an item of the item type. Examples of item types can include advertisements, auction based items (e.g., products or services), forms of energy, transportation services, vacation services, and utility services.

For example, the data 112 can contain the factual cost values of all the content campaigns for the page 116, including all CPM bids, and all winning CPM bids. In one implementation, the proposal component 120 can create a mapping from the winning CPM bids to the percent that each bid value is a winning bid. For example, page 116 has a total of 100 content campaigns. A bid value of $50 won 9 times during the 100 content campaigns. In this example, a bid value of $50 won 9% of the time (9 winning bids divided by a total of 100 content campaigns). In another implementation, the proposal component 120 can create a mapping from the winning CPM bids to the percent that each bid value was made. For example, throughout all of the content campaigns on the page 116 there are a total of 100 bids at $75. Twenty-two of the bids at $75 won a campaign. In this example, a $75 bid won content campaigns on the page 116 22% of the time that a $75 bid was made (22 winning bids at $75 divided by a total of 100 bids at $75). In some implementations, the percentage value associated with a bid value can be cumulative or otherwise collective. For example, a bid of $10 won 5% of the content campaigns for the page 116 and a bid of $20 won 11%. In this example, a bid of $10 is associated with 5% and a bid of $20 is associated with 16% ($10 bids won 5% of the content campaigns plus $20 bids won 11%).

In some implementations, the proposal component 120 caps the mapping with a highest factual cost value and/or lowest cost value. For example, when one or more bids are outside the standard deviation of the mapping, the one or more bids can be excluded from the mapping. In other implementations, a subset of the factual cost values can be excluded if they are based on a different value type. For example, CPM impression values can be included and CPM click-through values can be excluded; or silent auction values can be excluded and live auction values can be included; among others. In certain implementations, a highest factual and/or lowest factual cost value can be selected by some other method, such that factual cost values above or below the highest or lowest value, respectively, are not included in the mapping.

Step 304 identifies an inflection point in the mapping that represents a first factual cost value. For example, the proposal component 120 can identify the inflection point by an approach that can be exemplified using a visual representation of the mapping, such as the graph 200. The inflection point can be determined by finding the "knee" in the data that makes up the graph 200 (e.g., where the slope gets steeper than it was originally or takes off), the average value in the mapping, the first place in the graph 200 where the slope of the line 210 is greater than one, or the first place where the derivative of the line 210 is equal to or greater than one, to name a few examples. Continuing the example, the "knee" of the graph can be the point 214 and the value of the point 214 corresponding with the vertical axis 202 (e.g., $40) is the first factual cost value.

Step 306 outputs a proposed value for the bidding process to a user. The proposed value is generated using the first factual cost value. For example, the process component 120 can use the CPM value of the point 214 (e.g., $40) to generate the proposed value. The proposed value can be the CPM value itself (e.g., $40) or can be otherwise generated from the CPM value. In some implementations, the proposal component 120 uses a projected model, such as an auction or campaign model, regarding the bidding process for a particular day to generate the proposed value. The proposed value can, for example, be a bidding amount that, based on historical data, is required to win the bidding process.

For example, the projected model can be determined based on historical data for a particular item type, such as an advertisement on the page 116. The historical data for the page 116 can be included in the data 112. The projected model can predict an average day for the page 116, such as the number of advertisements shown on the page and the number of people who view the page 116, to name a few examples. In some implementations, the projected model is an average of all the daily bidding processes on the page 116. In other implementations, holidays, seasons, weather, date, time of day, events (e.g., the Olympic games), or any combination thereof, influence the projected model and the estimated bidding process for a particular day. In certain implementations, the date of the historical data can affect the projected model, such that either older or newer data has a greater influence on the projected model.

Figure 4:
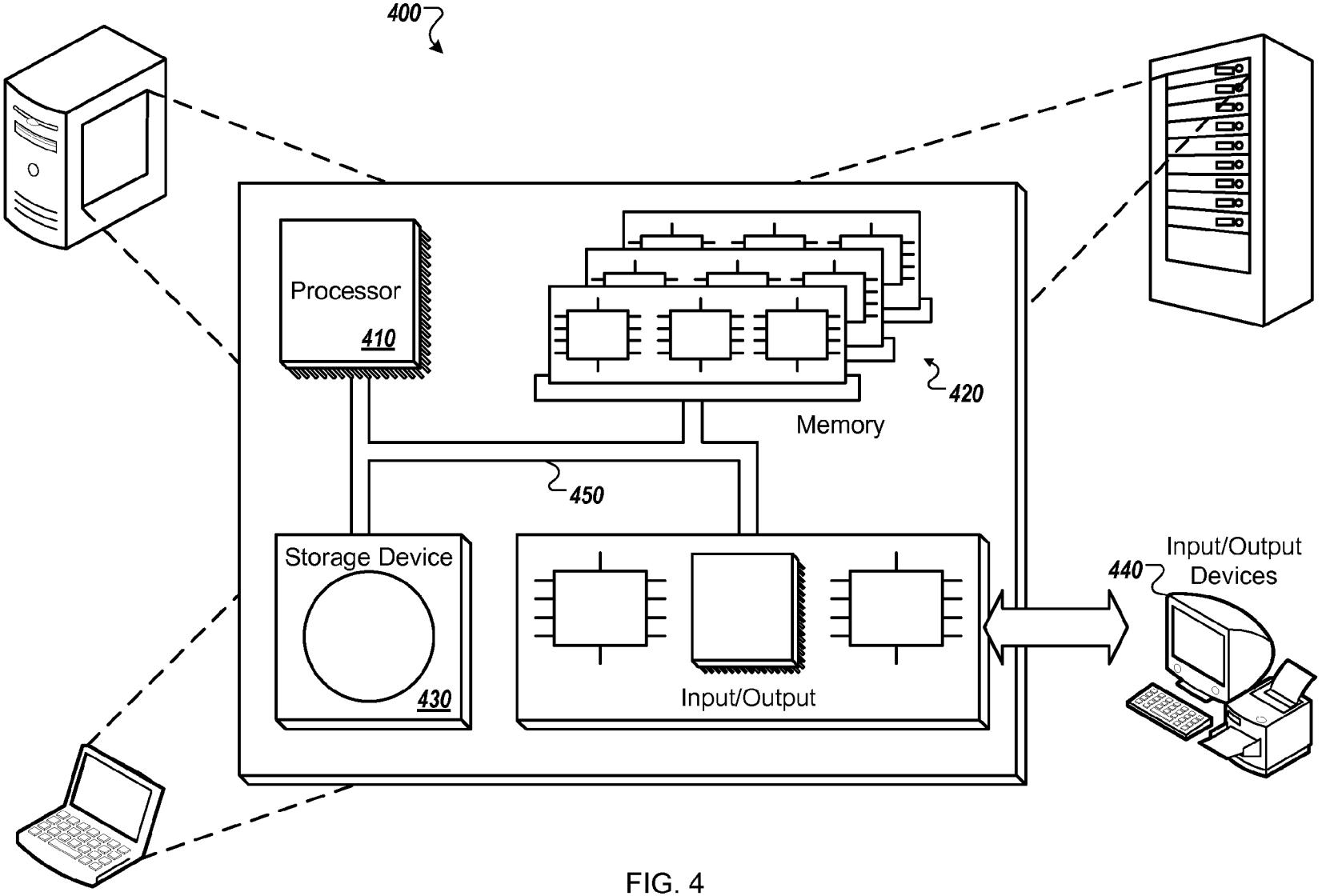
FIG. 4 is a block diagram of a computing system that can be used in connection with computer-implemented methods described in this document.

FIG. 4 is a schematic diagram of a generic computer system 400. The system 400 can be used for the operations described in association with any of the computer-implement methods described previously, according to one implementation. The system 400 includes a processor 410, a memory 420, a storage device 430, and an input/output device 440. Each of the components 410, 420, 430, and 440 are interconnected using a system bus 450. The processor 410 is capable of processing instructions for execution within the system 400. In one implementation, the processor 410 is a single-threaded processor. In another implementation, the processor 410 is a multi-threaded processor. The processor 410 is capable of processing instructions stored in the memory 420 or on the storage device 430 to display graphical information for a user interface on the input/output device 440.

The memory 420 stores information within the system 400. In one implementation, the memory 420 is a computer-readable medium. In one implementation, the memory 420 is a volatile memory unit. In another implementation, the memory 420 is a non-volatile memory unit.

The storage device 430 is capable of providing mass storage for the system 400. In one implementation, the storage device 430 is a computer-readable medium. In various different implementations, the storage device 430 may be a floppy disk device, a hard disk device, an optical disk device, or a tape device.

The input/output device 440 provides input/output operations for the system 400. In one implementation, the input/output device 440 includes a keyboard and/or pointing device. In another implementation, the input/output device 440 includes a display unit for displaying graphical user interfaces.

The features described can be implemented in digital electronic circuitry, or in computer hardware, firmware, software, or in combinations of them. The apparatus can be implemented in a computer program product tangibly embodied in an information carrier, e.g., in a machine-readable storage device, for execution by a programmable processor; and method steps can be performed by a programmable processor executing a program of instructions to perform functions of the described implementations by operating on input data and generating output. The described features can be implemented advantageously in one or more computer programs that are executable on a programmable system including at least one programmable processor coupled to receive data and instructions from, and to transmit data and instructions to, a data storage system, at least one input device, and at least one output device. A computer program is a set of instructions that can be used, directly or indirectly, in a computer to perform a certain activity or bring about a certain result. A computer program can be written in any form of programming language, including compiled or interpreted languages, and it can be deployed in any form, including as a stand-alone program or as a module, component, subroutine, or other unit suitable for use in a computing environment.

Suitable processors for the execution of a program of instructions include, by way of example, both general and special purpose microprocessors, and the sole processor or one of multiple processors of any kind of computer. Generally, a processor will receive instructions and data from a read-only memory or a random access memory or both. The essential elements of a computer are a processor for executing instructions and one or more memories for storing instructions and data. Generally, a computer will also include, or be operatively coupled to communicate with, one or more mass storage devices for storing data files; such devices include magnetic disks, such as internal hard disks and removable disks; magneto-optical disks; and optical disks. Storage devices suitable for tangibly embodying computer program instructions and data include all forms of non-volatile memory, including by way of example semiconductor memory devices, such as EPROM, EEPROM, and flash memory devices; magnetic disks such as internal hard disks and removable disks; magneto-optical disks; and CD-ROM and DVD-ROM disks. The processor and the memory can be supplemented by, or incorporated in, ASICs (application-specific integrated circuits).

To provide for interaction with a user, the features can be implemented on a computer having a display device such as a CRT (cathode ray tube) or LCD (liquid crystal display) monitor for displaying information to the user and a keyboard and a pointing device such as a mouse or a trackball by which the user can provide input to the computer.

The features can be implemented in a computer system that includes a back-end component, such as a data server, or that includes a middleware component, such as an application server or an Internet server, or that includes a front-end component, such as a client computer having a graphical user interface or an Internet browser, or any combination of them. The components of the system can be connected by any form or medium of digital data communication such as a communication network. Examples of communication networks include, e.g., a LAN, a WAN, and the computers and networks forming the Internet.

The computer system can include clients and servers. A client and server are generally remote from each other and typically interact through a network, such as the described one. The relationship of client and server arises by virtue of computer programs running on the respective computers and having a client-server relationship to each other.

A number of implementations have been described. Nevertheless, it will be understood that various modifications may be made without departing from the spirit and scope of this disclosure. Accordingly, other implementations are within the scope of the following claims.

What is claimed is:

1. A computer-implemented method for proposing a value to a user, the method comprising:

mapping, by one or more processors, each of multiple bids for an item type with a percentage of bidding processes for items of the item type that were won using that bid;

generating, by the one or more processors, a graph of the mapping;

identifying a rectangle that has a first corner at a specific bid value and a second corner opposite to the first corner at a point on the mapping, and that is larger than any other rectangle that has a corner at the specific bid value and an opposite corner on the mapping;

identifying, by the one or more processors, a first bid associated with the point on the mapping or with a corresponding point in a normalized mapping; and outputting, the one or more processors, a proposed value for the bidding process to a user, the proposed value generated using the first bid.

2. The computer-implemented method of claim 1, wherein generating the graph comprises:

arranging the multiple bids according to amount.

3. The computer-implemented method of claim 2, wherein the multiple bids are arranged in non-decreasing order along a horizontal axis of the graph.

4. The computer-implemented method of claim 3, wherein the graph includes bids that have won or are projected to win the bidding process for impression on site placement.

5. The computer-implemented method of claim 1, further comprising applying a normalizing multiplicative factor to obtain the normalized mapping; and identifying the first bid in the normalized mapping.

6. The computer-implemented method of claim 1, further comprising: capping the mapping at a highest bid, such that higher bids are not included in the mapping.

7. The computer-implemented method of claim 1, wherein the proposed value is generated using a projected auction model regarding the bidding process for a site placement on a particular day.

8. The computer-implemented method of claim 1, wherein the item type comprises electronic publishing of content, and wherein the proposed value is determined to generate an estimated number of impressions for the content.

9. The computer-implemented method of claim 8, wherein the content is an advertisement from an advertiser seeking to participate in a bidding process to publish the advertisement.

10. The computer-implemented method of claim 1, wherein the proposed value comprises a bidding amount that based on historical data is required to win the bidding process.

11. The computer-implemented method of claim 1, wherein the item type includes at least one of tangible objects and services offered at an auction.

12. The computer-implemented method of claim 1, wherein the item type includes a transportation service.

13. The computer-implemented method of claim 1, wherein the item type includes energy provided from an energy distributor for consumption.

14. A computer program product tangibly embodied in a non-transitory computer-readable storage medium and comprising instructions that when executed by a processor cause the processor to perform a method for proposing a value to a user, the method comprising:

mapping by one or more processors, each of multiple bids for an item type with a percentage of bidding processes for items of the item type that were won using that bid;

generating, by the one or more processors, a graph of the mapping;

identifying a rectangle that has a first corner at a specific bid value and a second corner opposite to the first corner at a point on the mapping, and that is larger than any other rectangle that has a corner at the specific bid value and an opposite corner on the mapping;

identifying, by the one or more processors, a first bid associated with the point on the mapping or with a corresponding point in a normalized mapping; and outputting, by the one or more processors, a proposed value for the bidding process to a user, the proposed value generated using the first bid.

15. A computer system comprising:

one or more processors;

a tangible medium including (i) a mapping of each of multiple bids for an item type with a percentage of bidding processes for items of the item type that were won using that bid, (ii) a graph of the mapping, and (iii) instructions that when executed cause the computer system to generate a proposal component generating a proposed value, including identifying a rectangle that has a first corner at a specific bid value and a second corner opposite to the first corner at a point on the mapping, and that is larger than any other rectangle that has a corner at the specific bid value and an opposite corner on the mapping, and identifying a first bid associated with the point on the mapping or with a corresponding point in a normalized mapping; and an output device outputting the proposed value for the bidding process to a user.

16. The computer system of claim 15, wherein the proposal component generates the graph of the mapping.

* * * * *

UNITED STATES PATENT AND TRADEMARK OFFICE

CERTIFICATE OF CORRECTION

PATENT NO. : 8,255,285 B1
APPLICATION NO. : 12/394392
DATED : August 28, 2012
INVENTOR(S) : Ervin Peretz and Sasank Mudunuri It is certified that error appears in the above-identified patent and that said Letters Patent is hereby corrected as shown below:

Column 11, Line 55 (Claim 1), delete “the” and insert -- by the --, therefor.

Column 12, Line 32 (Claim 14), delete “mapping” and insert -- mapping, --, therefor.

Signed and Sealed this
Ninth Day of October, 2012

David J. Kappos

David J. Kappos
*Director of the United States Patent and Trademark Office*